US006814057B2

(12) United States Patent
Mahr et al.

(10) Patent No.: US 6,814,057 B2
(45) **Date of Patent: *Nov. 9, 2004**

(54) FUEL INJECTION DEVICE

(75) Inventors: Bernd Mahr, Plochingen (DE); Martin Kropp, Tamm (DE); Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/276,148

(22) PCT Filed: Mar. 12, 2002

(86) PCT No.: PCT/DE02/00860

§ 371 (c)(1),
(2), (4) Date: May 19, 2003

(87) PCT Pub. No.: WO02/073024

PCT Pub. Date: Sep. 19, 2002

(65) Prior Publication Data

US 2003/0183198 A1 Oct. 2, 2003

(30) Foreign Application Priority Data

Mar. 14, 2001 (DE) ..... 101 12 154

(51) Int. Cl.[7] ..... F02M 33/04
(52) U.S. Cl. ..... 123/446; 123/447
(58) Field of Search ..... 123/446, 447, 123/467

(56) References Cited

U.S. PATENT DOCUMENTS

| | | | | | |
|---|---|---|---|---|---|
| 4,844,035 | A | | 7/1989 | Takagi | |
| 5,615,656 | A | * | 4/1997 | Mathis | 123/447 |
| 5,622,152 | A | * | 4/1997 | Ishida | 123/446 |
| 6,491,017 | B1 | * | 12/2002 | Mahr et al. | 123/447 |
| 6,619,263 | B1 | * | 9/2003 | Mahr et al. | 123/447 |
| 6,655,355 | B2 | * | 12/2003 | Kropp et al. | 123/467 |

FOREIGN PATENT DOCUMENTS

DE 199 39 420 3/2001

* cited by examiner

*Primary Examiner*—Thomas Moulis
(74) *Attorney, Agent, or Firm*—Ronald E. Greigg

(57) ABSTRACT

A fuel injection system for internal combustion engines has at least one stroke-controlled injector. A pressure booster that has a movable piston is connected between the at least one injector and a high-pressure working medium source. The movable piston divides a primary chamber, which can be connected to the high-pressure working medium source, from a pressure chamber that communicates with the at least one injector and is filled with fuel. The pressure booster generates a first fuel system pressure in the injector, which is used for the injection. The fuel injection system has means for furnishing a further, second fuel system pressure, and these means can be used for injection without activating the pressure booster.

14 Claims, 7 Drawing Sheets

FUEL INJECTION DEVICE

CROSS-REFERENCE TO RELATED APPLICATIONS

This application is a 35 USC 371 application of PCT/DE 02/00860, filed on Mar. 12, 2002.

BACKGROUND OF THE INVENTION

1. Field of the Invention

The invention relates to an improved fuel injection system for internal combustion engines.

2. Description of the Prior Art

For introducing fuel into direct-injection Diesel engines, both stroke- and pressure-controlled fuel injection systems are known. For better comprehension of the description and claims, several terms will first be explained: The fuel injection according to the invention can be done by either stroke or pressure control. Within the scope of the invention, a stroke-controlled fuel injection is understood to mean that the opening and closing of the injection opening is accomplished with the aid of a displaceable valve member because of the hydraulic cooperation of the pressures in a nozzle chamber and in a control chamber. A pressure reduction within the control chamber causes a stroke of the valve member. Alternatively, the deflection of the valve member can be accomplished by a final control element (actuator). In a pressure-controlled fuel injection according to the invention, the valve member is moved counter to the action of a closing force (spring) by the fuel pressure prevailing in the nozzle chamber of an injector, so that the injection opening is opened for an injection of the fuel from the nozzle chamber into the cylinder. The pressure at which fuel emerges from the nozzle chamber into a cylinder of an internal combustion engine is called the injection pressure, while a system pressure is understood to mean the pressure at which fuel is available or is kept on hand within the fuel injection system. Fuel metering means furnishing a defined fuel quantity for injection. The term or leak fuel, is understood to mean a quantity of fuel that occurs in operation of the fuel injection system (such as a reference leakage) and is not used for injection and is pumped back to the fuel tank. This leak fuel can have a standing pressure, after which the fuel is depressurized to the pressure level of the fuel tank.

It is also known to use a pressure booster, in order to have not only the rail pressure but a further, different injection pressure available. The use of a separate working medium (such as hydraulic oil) for actuating the pressure booster has the disadvantage that it is no longer possible to use the rail pressure as the injection pressure.

SUMMARY OF THE INVENTION

For embodying a flexible fuel injection system which uses a separate working medium (hydraulic oil) for actuating the pressure booster, a fuel injection system is proposed according to the invention.

To enhance the flexibility of a fuel injection system, besides the fuel pressure of the hydraulic oil-actuated pressure booster (first system pressure), a further, second (low) fuel system pressure is generated, which can be used for injection. The second system pressure is stored as needed in a pressure reservoir and is applied constantly to the injector. A flexible shaping of the injection course and multiple injection can be attained. For generating pressure, a separate high-pressure pump can be used. However, it is also possible for the fuel pressure to be generated with a central pressure booster. Advantageously, the second system pressure can also be furnished by means of storage of a portion of the fuel compressed by the pressure booster.

If the fuel pressure is selected to be higher than the oil pressure in the pressure reservoir, then a hydraulic restoring force acts on a piston of the local pressure booster. The requisite restoring spring can thus be reduced in size or even omitted. This has a major advantage in terms of installation space, which is important especially for integrating the pressure booster with the injector.

BRIEF DESCRIPTION OF THE DRAWINGS

Seven exemplary embodiments of the fuel injection system of the invention are described in detail herein below, with reference to the drawings, in which.

DESCRIPTION OF THE PREFERRED EMBODIMENTS

Figure 1:
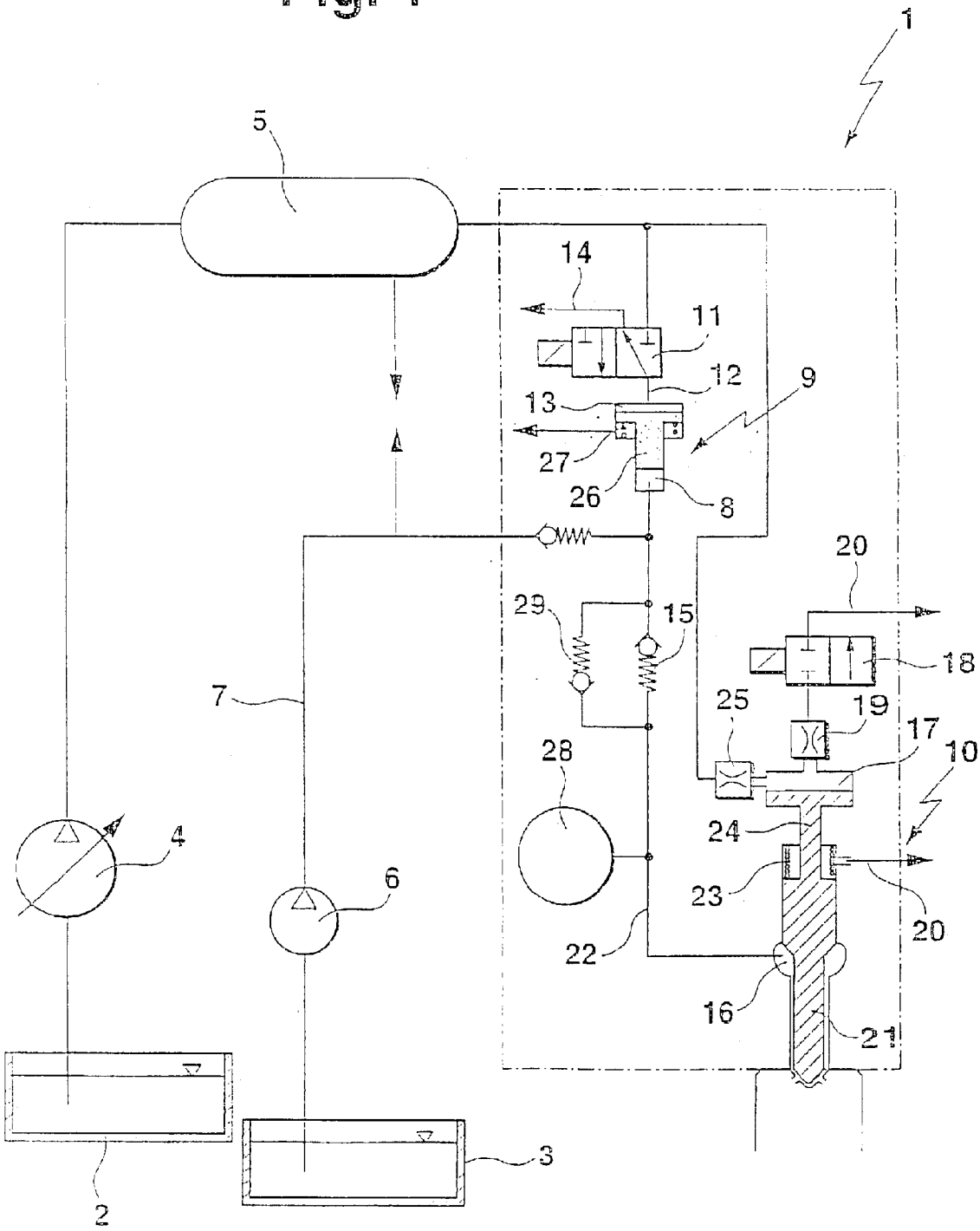
FIG. 1, the use of hydraulic oil for actuating a local pressure booster and for triggering an injector.

In the first exemplary embodiment of a fuel injection system 1, shown in FIG. 1, a supply container 2 for a working medium (such as hydraulic oil) and a supply container 3 for fuel are used. A high-pressure pump 4 pumps the working medium, that is, hydraulic oil, into a central pressure reservoir 5, in which the hydraulic oil is compressed to a controllable system pressure of approximately 50 bar to 250 bar and is stored. Thus the pressure reservoir 5 furnishes a high-pressure working medium source.

A low-pressure fuel pump 6 pumps fuel 3 via a supply line 7 into a pressure chamber 8 of a pressure booster 9. Each injector 10 is assigned one local pressure booster 9. In FIG. 1, only one pressure booster 9 and one injector 10 are shown. With the aid of a 3/2-way valve 11, the triggering of the pressure booster 9 can be done, in that a supply line 12 to a primary chamber 13 of the pressure booster 9 can be connected either to an oil return 14 or to the pressure reservoir 5. The pressure chamber 8 communicates via a check valve 15 with a nozzle chamber 16 of the injector 10, so that a pressure buildup in the nozzle chamber 16 can take place. A control chamber 17 of the injector 10 is connected to the pressure reservoir 5 and, with the aid of a 2/2-way valve 18 and a pressure relief throttle 19, can be made to communicate with an oil return 20, so that the pressure in the control chamber 17 can be varied.

The injection is effected via a fuel metering, with the aid of a nozzle needle 21, which is axially displaceable in a guide bore and cooperates with a valve seat face on the housing of the injector 10. On the valve seat face of the injector housing, injection openings are provided. Inside the nozzle chamber 16, a pressure face pointing in the opening direction of the nozzle needle 21 is exposed to the pressure prevailing there, which is delivered to the nozzle chamber 16 via the supply line 22. Also engaging the nozzle needle, coaxially with a valve spring 23, is a thrust member 24, which defines the control chamber 17. From the fuel pressure connection, the control chamber 17 has an inlet with a first throttle 25, and it has an outlet via the oil return 20 and the 2/2-way valve 18.

The nozzle chamber 16 continues, via an annular gap between the nozzle needle 21 and the guide bore, as far as the valve seat face of the injector housing. Via the pressure in the control chamber 17, the thrust member 24 is subjected to pressure in the closing direction.

The control of the injector 10 is effected hydraulically by the cooperation of the pressures in the nozzle chamber 16 and in the control chamber 17 (given suitable design of the pressure faces). When the valve 20 is opened, the pressure in the control chamber 17 drops, and the nozzle needle 21 uncovers the injection openings. The injection begins. When the valve 20 is closed, a rail pressure builds up again in the control chamber 17, and the nozzle needle 21 closes the injection openings.

For injection of fuel at a system pressure that is elevated compared to the pressure reservoir 5, each injector 10 is assigned its own local pressure booster 9. The pressure booster 9 includes the 3/2-way valve 11 for triggering, as well as a check valve and a piston 26. The movable piston 26 divides the primary chamber 13, which is connectable to the pressure reservoir 5, from a fuel-filled pressure chamber 8 that communicates with the at least one injector 10. The piston 26 can be acted upon by pressure on one end. A differential chamber 27 is pressure-relieved by means of a leak fuel line, so that the piston 26 can be displaced in order to reduce the volume of the pressure chamber 8. The piston 26 is moved in the compression direction, so that the fuel located in the pressure chamber B is compressed and delivered to the control chamber 17 and to the nozzle chamber 16. A check valve prevents the return flow of compressed fuel to the fuel tank. By means of a suitable ratio of surface area in the primary chamber 13 and the pressure chamber 8, an elevated pressure can be generated. If the primary chamber 13 is connected to the leak fuel line 14 with the aid of the valve 11, the restoration of the piston and the refilling of the pressure chamber 8 are effected. To improve the restoration performance, one or more springs may be provided. By means of the pressure boost, a first fuel system pressure is thus generated.

By means of the check valve 15, the nozzle chamber 16 and a local pressure reservoir 28 remain under pressure when the pressure booster is pressure-relieved by the valve 11. Thus a constant fuel pressure is applied to the injector 10. An injection at arbitrary times is possible, even if the pressure booster 9 is not triggered and thus is not compressing any fuel in the compression chamber 8. A second, low fuel system pressure is generated, which can be used for the injection. The pressure in the pressure reservoir 28 can be set to a desired level by means of an overpressure valve 29. To that end, the pressure in the pressure reservoir 28 can drop, via the valve 29, down to its opening pressure. Thus a low pressure level of approximately 300 to 500 bar can preferably be set. In that case, a preinjection, boot phase of a main injection, and a graduated postinjection can be defined for regenerating exhaust gas posttreatment systems, for instance. The size of the pressure reservoir 28 must be designed to suit the desired injection course. Preferably, the local pressure reservoir is used only for a small preinjection and a short boot phase. Then it can be very small and may even be formed by the existing lines and spaces.

Figure 2:
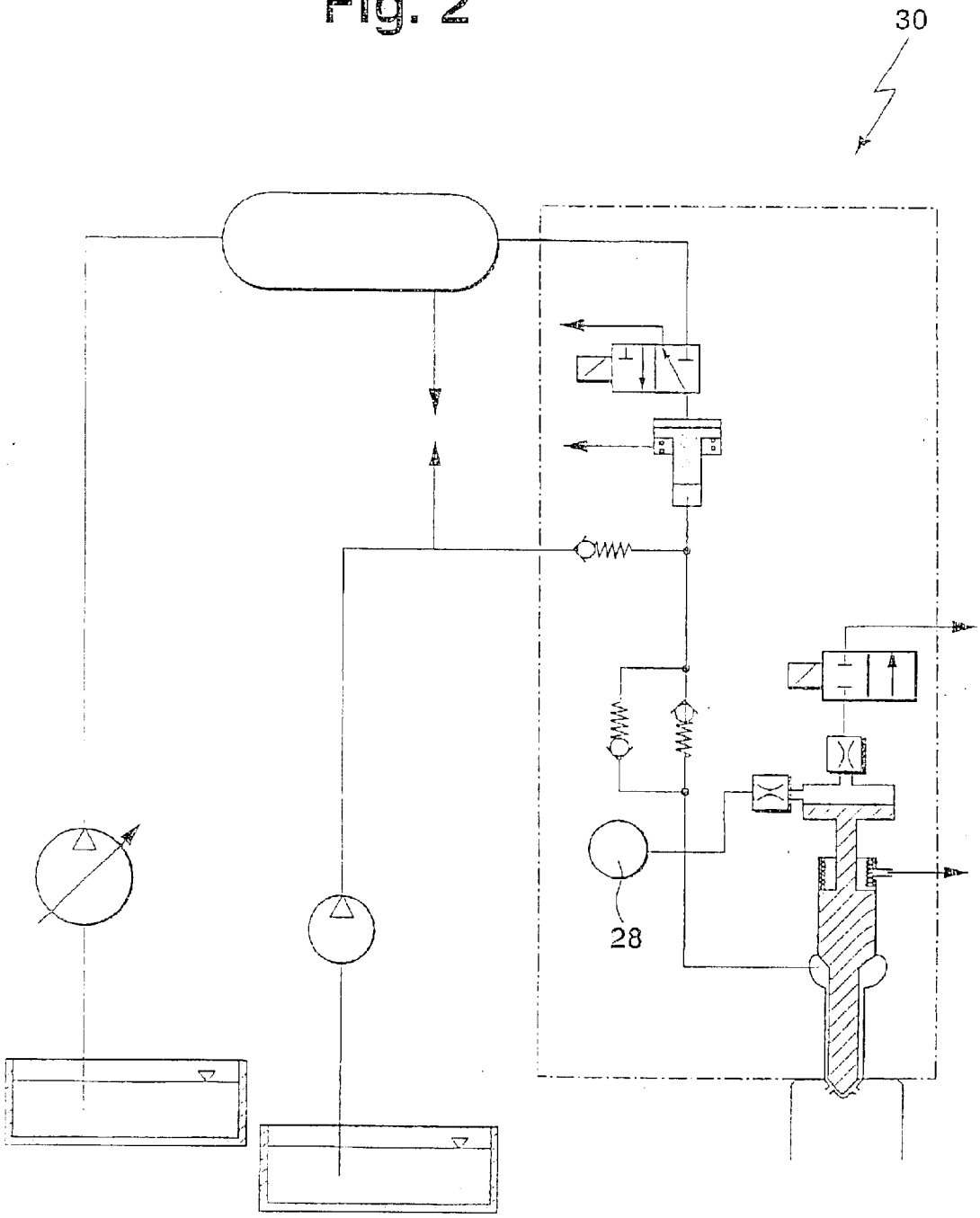
FIG. 2, the use of hydraulic oil for actuating the local pressure booster and of fuel for triggering the injector.

For triggering the injector, in the embodiment of FIG. 2 (fuel injection system 30), compressed fuel from the nozzle region is used, instead of the hydraulic oil from the pressure reservoir 5. The pressure reservoir 28 is designed accordingly.

Figure 3:
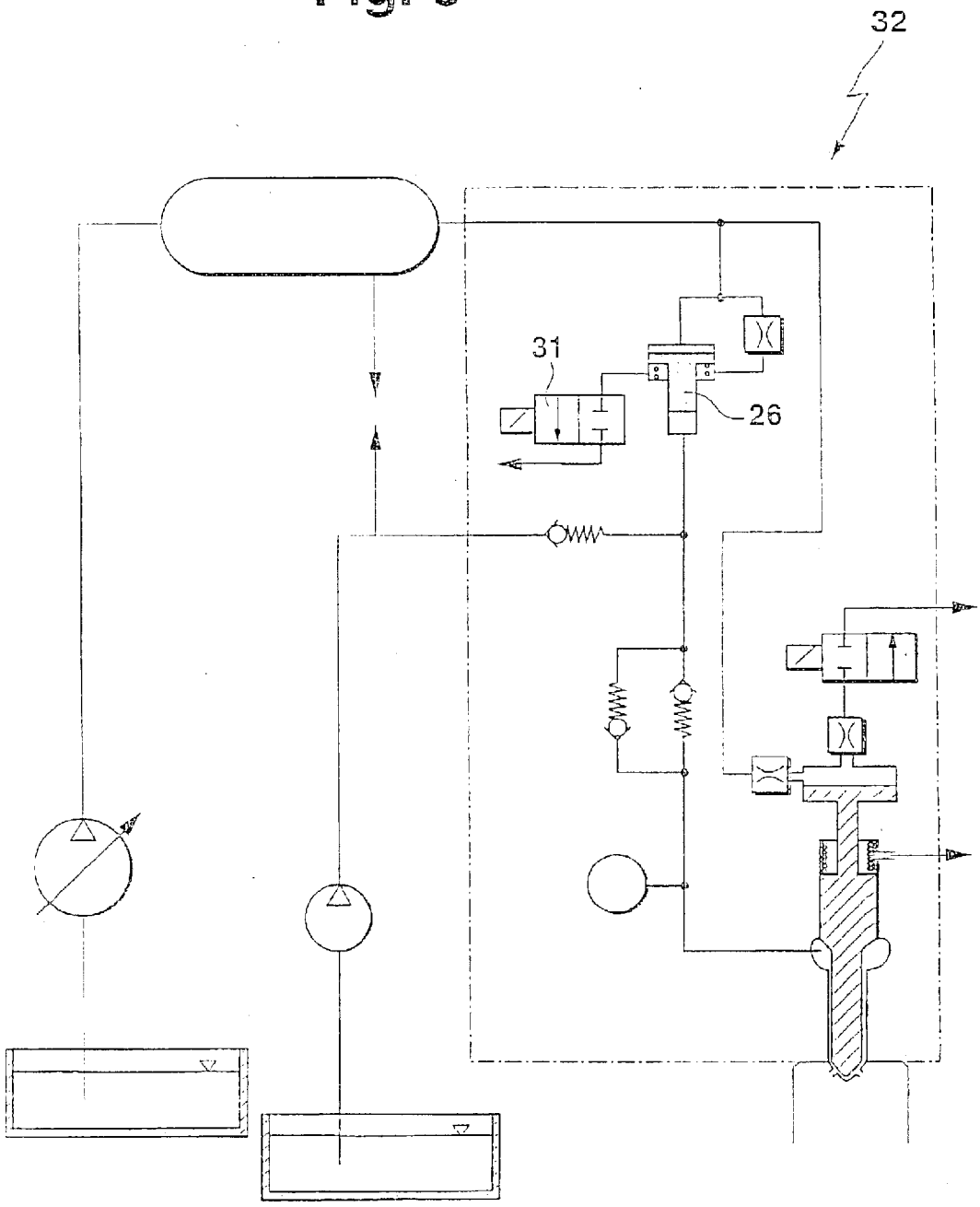
FIG. 3, a different triggering of the pressure booster, using hydraulic oil for actuating the local pressure booster and for triggering the injector.

FIG. 3 shows a different triggering of the pressure booster 9, with a 2/2-way valve 31 in a fuel injection system 32. The piston 26, in the deactivated state upon restoration, is not completely hydraulically pressure-equalized. An increased spring force compensates for this.

Figure 4:
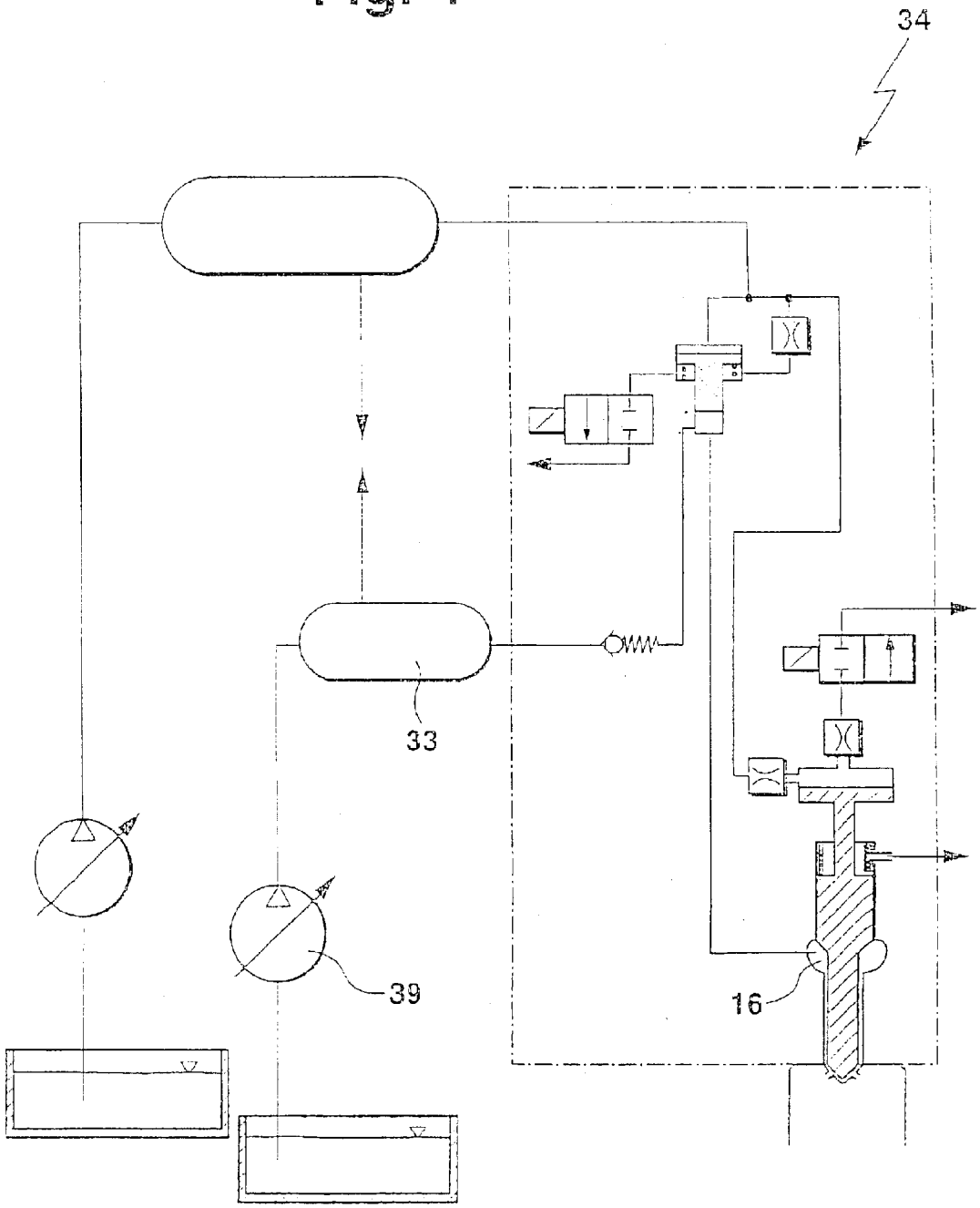
FIG. 4, the use of hydraulic oil for actuating the local pressure booster and triggering the injector that is connected to a central pressure reservoir.

To solve this problem differently, an elevated fuel pilot pressure can be used. In FIG. 4, in a fuel injection system 34, a second (low) fuel system pressure is provided, which furnishes a basic fuel pressure in the system. The second fuel system pressure is generated by a fuel high-pressure pump 39. As needed, this second fuel system pressure can be stored in a central pressure reservoir 33.

The second fuel system pressure is connected to the pressure chamber 8 and to the nozzle chamber 16. The nozzle chamber 16 is therefore always subjected to fuel pressure. This fuel pressure can be used at any time for an injection and can thus be used for instance for a preinjection or a boot phase.

For the pressure reservoir 33, a pressure control may be provided. If the second system pressure is selected as higher than the oil pressure of the working medium, then the piston experiences a hydraulic restoring force, and if there are installation space problems, a restoring spring can be dispensed with.

Figure 5:
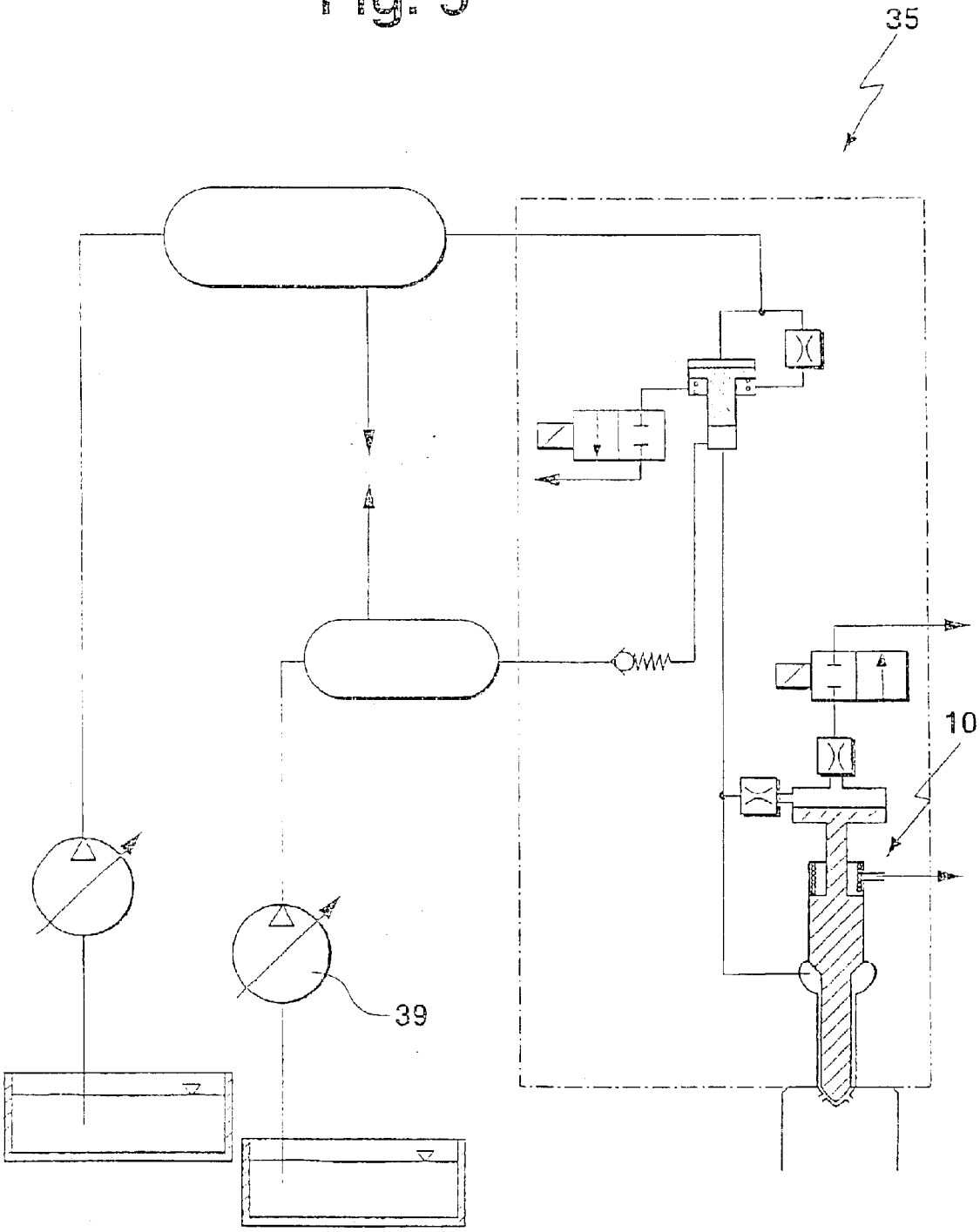
FIG. 5, the use of hydraulic oil for actuating the local pressure booster and of fuel for triggering the injector that is connected to a central pressure reservoir.

A fuel injection system 35 in FIG. 5 is equivalent to that of FIG. 4. Instead of the hydraulic oil, fuel is used here for triggering the injector 10.

Figure 6:
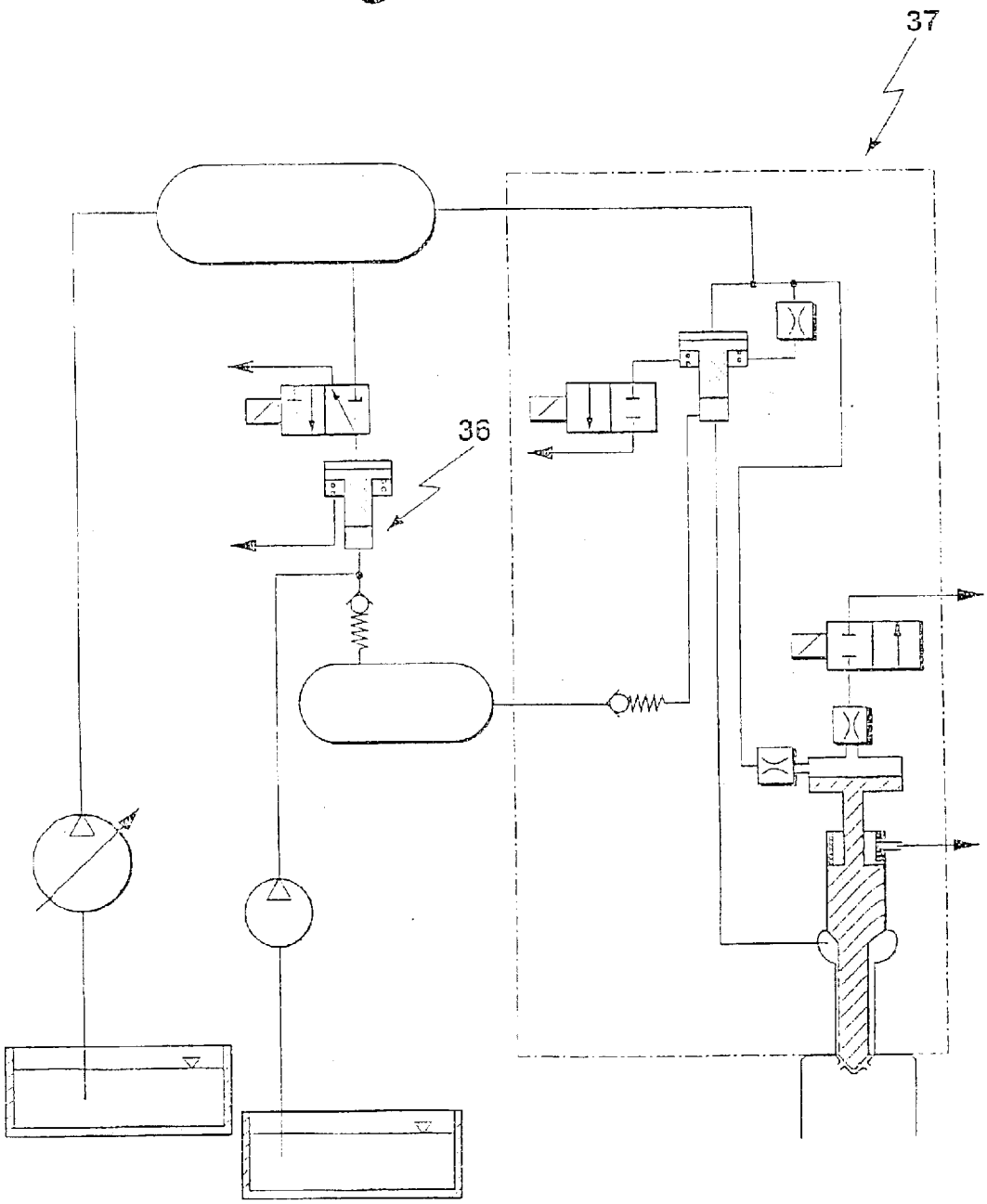
FIG. 6, the use of a central pressure booster.

For generating the second fuel system pressure (basic fuel pressure), instead of a high-pressure pump a central pressure booster 36 can also be used (fuel injection system 37 in FIG. 6). For pressure control and/or vibration damping, once again a pressure reservoir 33 can be used.

Figure 7:
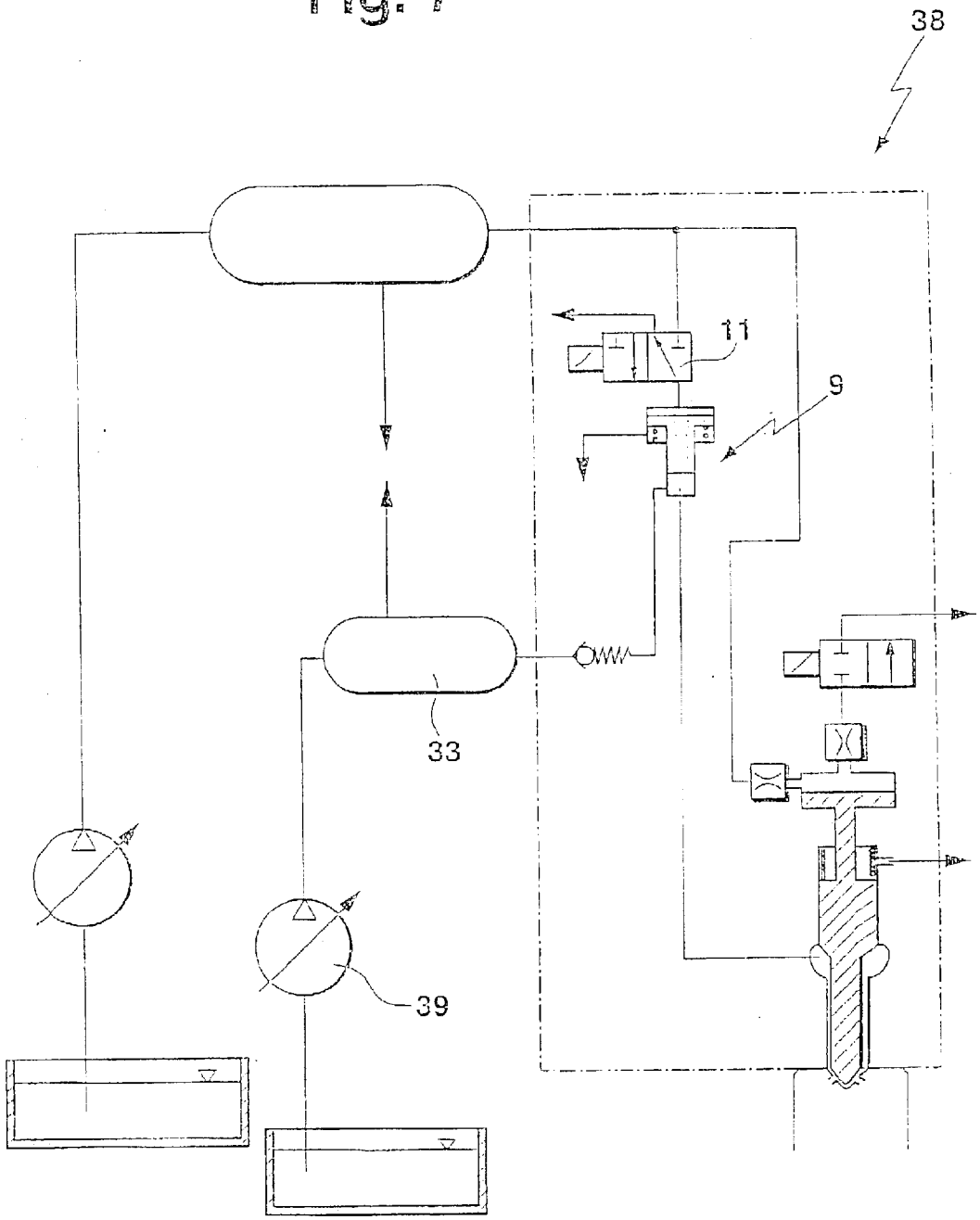
FIG. 7, a further triggering of the local pressure booster.

FIG. 7 shows a further circuitry option; the 3/2-way valve 11 is provided for controlling the pressure booster 9 in a fuel injection system 38 with a central pressure reservoir 33. In this circuitry option, the piston experiences a hydraulic restoring force, and if there are installation space problems, a restoring spring can be dispensed with.

The foregoing relates to preferred exemplary embodiments of the invention, it being understood that other variants and embodiments thereof are possible within the spirit and scope of the invention, the latter being defined by the appended claims.

What is claimed is:

1. A fuel injection system (1; 30; 32; 34; 35; 37; 38) for internal combustion engines, comprising at least one stroke-controlled injector (10), a high pressure working medium source (5), a pressure booster (9) having a movable piston (26) connected between the at least one injector (10) and the high-pressure working medium source (5), the movable piston (26) dividing a primary chamber (13), which is connectable to the high-pressure working medium source (5), from a pressure chamber (8), which communicates with the at least one injector (10) and is filled with fuel, the pressure booster (9) generating a first fuel system pressure in the injector (10), which pressure is used for injection, and means for furnishing a further, second fuel system pressure, which means can be used for injection without activating the pressure booster (9), further comprising means for generating the second fuel system pressure from the first fuel system pressure, which first fuel system pressure is compressed by the pressure booster (9).

2. The fuel injection system of claim 1 further comprising separate local reservoirs for furnishing the second fuel system pressure for each injector (10).

3. The fuel injection system of claim 1 further comprising means for furnishing the second fuel system pressure jointly for all the injectors (10).

4. The fuel injection system of claim 1 further comprising means for furnishing the second fuel system pressure jointly for all the injectors (10).

5. The fuel injection system of claim 3 further comprising a central reservoir for the second fuel pressure.

6. The fuel injection system of claim 4 further comprising a central reservoir for the second fuel pressure.

7. The fuel injection system of claim 3 further comprising a high-pressure pump for generating the second, central fuel pressure.

8. The fuel injection system of claim 4 further comprising a high-pressure pump for generating the second, central fuel pressure.

9. The fuel injection system of claim 5 further comprising a high-pressure pump for generating the second, central fuel pressure.

10. The fuel injection system of claim 6 further comprising a high-pressure pump for generating the second, central fuel pressure.

11. The fuel injection system of claim 3 further comprising a pressure booster for generating the second fuel pressure.

12. The fuel injection system of claim 4 further comprising a pressure booster for generating the second fuel pressure.

13. The fuel injection system of claim 5 further comprising a pressure booster for generating the second fuel pressure.

14. The fuel injection system of claim 6 further comprising a pressure booster for generating the second fuel pressure.

* * * * *